US009446895B2

(12) United States Patent
Mekata

(10) Patent No.: US 9,446,895 B2
(45) Date of Patent: Sep. 20, 2016

(54) TWO LIQUID DISPENSER

(71) Applicant: DAIZO CORPORATION, Osaka-shi, Osaka (JP)

(72) Inventor: Satoshi Mekata, Osaka (JP)

(73) Assignee: DAIZO CORPORATION, Osaka (JP)

( * ) Notice: Subject to any disclaimer, the term of this patent is extended or adjusted under 35 U.S.C. 154(b) by 0 days.

(21) Appl. No.: 14/363,708

(22) PCT Filed: Dec. 6, 2012

(86) PCT No.: PCT/JP2012/081663

§ 371 (c)(1),
(2) Date: Jun. 6, 2014

(87) PCT Pub. No.: WO2013/084996

PCT Pub. Date: Jun. 13, 2013

(65) Prior Publication Data

US 2014/0361038 A1 Dec. 11, 2014

(30) Foreign Application Priority Data

Dec. 7, 2011 (JP) ..... 2011-268437
Dec. 14, 2011 (JP) ..... 2011-273929

(51) Int. Cl.
*B65D 35/28* (2006.01)
*B65D 83/62* (2006.01)
*B65D 83/38* (2006.01)
(Continued)

(52) U.S. Cl.
CPC ..... *B65D 83/62* (2013.01); *B65D 83/384* (2013.01); *B65D 83/48* (2013.01); *B65D 83/682* (2013.01)

(58) Field of Classification Search
CPC ..... B65D 83/62; B65D 83/384; B65D 83/48
USPC ..... 222/136, 402.1, 95, 402.21, 145.5, 105
See application file for complete search history.

(56) References Cited

U.S. PATENT DOCUMENTS 3,474,934 A 10/1969 Forim
3,581,942 A * 6/1971 Thornton ..... 222/95
(Continued)

FOREIGN PATENT DOCUMENTS

DE 10 2009 055 125 A1 5/2011
JP 7-89581 A 4/1995
JP 2011-251710 A 12/2011

OTHER PUBLICATIONS

International Search Report for the Application No. PCT/JP2012/081663 mailed Feb. 26, 2013.
(Continued)

*Primary Examiner* — Donnell Long
(74) *Attorney, Agent, or Firm* — Cheng Law Group, PLLC

(57) ABSTRACT

[Problem] Provided is a two-liquid dispenser storing two types of content, and capable of stably and equally discharging two liquids.
[Solution] A two-liquid dispenser (10) is provided with: a pressure-proof container (11); a flexible inner container (12) housed in the pressure-proof container; a pouch (13) housed in the inner container; a valve assembly (14) to close the pressure-proof container (11), the inner container (12), and the pouch (13); a first content (A1) filed in the pouch; a second content (A2) filled in a first space (S1) between the pressure-proof container (11) and the inner container (12); and a propellant (P) filled in a second space (S2) between the inner container (12) and the pouch.

7 Claims, 9 Drawing Sheets

(51) Int. Cl.
*B65D 83/48* (2006.01)
*B65D 83/68* (2006.01)

(56) References Cited

U.S. PATENT DOCUMENTS 4,673,107 A * 6/1987 Obrist ..... 222/94
7,267,248 B2 * 9/2007 Yerby et al. ..... 222/94
7,455,195 B2 11/2008 Mekata
2004/0084480 A1 5/2004 Domoy et al.
2006/0124663 A1 * 6/2006 Salemme ..... 222/95
2007/0241132 A1 * 10/2007 Smith ..... B65D 83/38 222/95

OTHER PUBLICATIONS

Supplementary European Search Report for the Application No. EP 12 85 6214 dated Aug. 21, 2015.

* cited by examiner

TWO LIQUID DISPENSER

FIELD OF INVENTION

The present invention relates to a two liquid dispenser.

DESCRIPTION OF BACKGROUND ART

Conventionally, there are an aerosol product which stores a content and a propellant in the same space and which dispenses both at the same time, and an aerosol product which stores the content and the propellant in the different independent space and which dispenses the content by contracting the space filled with the content by the energy of the propellant. The latter aerosol product is known as a double aerosol container which is equipped with a pressure resistant container, a flexible inner bag housed in the pressure resistant container, and an aerosol valve closing both the pressure resistant container and the inner bag. The double aerosol container independently stores the content and the propellant by charging the propellant or the content in the space between the pressure resistant container and the inner bag, and charging the content or the propellant in the inner bag. And the content alone is dispensed, when the valve is been opened and the propellant presses the inner bag.

Further, there is two liquid dispenser equipped with an inner bag which can independently stores two contents and simultaneously dispenses two contents (Patent document 1). In the FIG. 1 of patent document 1, the two liquid dispenser in which the inner bag is partitioned into upper chamber and the lower chamber and the contents are stored into the upper chamber and the lower chamber respectively, is shown. In the FIG. 29 of patent document 1, the two liquid dispenser in which a bag is further housed in the inner bag and the each contents are stored in the bag and the inner bag respectively, is shown.

PRIOR ART DOCUMENTS

Patent Documents

Patent Document 1: Japanese Patent No. 4286154

SUMMARY OF THE INVENTION

However, in the two liquid dispensing product of FIG. 1 of Patent document 1, there is a problem that the intended effect is not obtained, in the case that two liquid reaction ingredients are used, which the ingredients gently reacts in the course of time because the inner bag is only partitioned by the plug. Further, in the two liquid dispensing product of FIG. 29 of Patent document 1, there is a problem that the intended effect is not obtained, because the first content and the second content are partitioned only by one dividing wall and the contents penetrates through the dividing wall. Moreover, in the two liquid dispensing product of FIG. 29 of Patent document 1, there is problem that the discharging rate of two liquid tends to be different due to the pressure differential of two liquid, because the content stored in the innermost bag receive the pressure of the propellant through the content stored outside the innermost bag.

Problems to be Solved

The present invention is directed to two liquid dispenser which can stably stores two liquid reaction type content containing reactive ingredients, and can stably dispense two contents at the same rate.

Means of Solving the Problem

The present invention of two liquid dispenser is characterized in that it comprises a tubular pressure resistant container with a bottom, an intermediate container having a flexibility, housed in the pressure resistant container, a pouch housed in the intermediate container, a valve assembly closing the pressure resistant container, the intermediate container, and the pouch, a first content stored in the pouch, a second content stored between the pressure resistant container and the intermediate container, and a propellant charged between the intermediate container and the pouch.

In the two liquid assembly of the present invention, the intermediate container may have an outer shape which is substantially same as an inner surface of the pressure resistant container. The intermediate container may be formed in the pressure resistant container by blow molding.

Effect of the Invention

In the two liquid assembly of the present invention, because it is equipped with a tubular pressure resistant container with a bottom, a flexible intermediate container housed in the pressure resistant container, a pouch housed in the intermediate container, a valve assembly closing the pressure resistant container, the intermediate container, and the pouch, a first content stored in the pouch, a second content stored between the pressure resistant container and the intermediate container, and a propellant charged between the intermediate container and the pouch; both the first content and the second content are stored adjacent to the propellant, therefore both contents receive same pressure. Further, because the first content and the second content are stored not adjacent to each other, the penetration of the one to the other can be prevented. Even if one of the content has high permeation property it must transmit through the propellant to reach to the other content, resultantly the durability is high. Moreover, because it uses the pouch made of sheet, the inner space of the pouch may be contracted and eliminated by pressuring, and resultantly the elimination of the inner space of the pouch can decrease the remaining amount of the content after the use.

In the case where an outer shape of the intermediate container is substantially same as an inner surface of the pressure resistant container, the first space can be eliminated by having the propellant to press the intermediate container to the inner surface of the pressure resistant container, resultantly the elimination of the first space can decrease the remaining amount of the second content.

Further, in the case where the intermediate container is formed in the pressure resistant container by blow molding, the sealing between the intermediate container and the valve assembly may be secured. That is the neck portion of the intermediate container maintains the condition of the parison (formed by mold injection) and the dimensional accuracy of the neck portion is high, the sealing between the intermediate container and the valve assembly may be secured by providing the sealing member between the inner surface of the neck portion of the intermediate container and the side wall of the valve assembly.

EMBODIMENT FOR CARRYING OUT THE INVENTION

Figure 1:
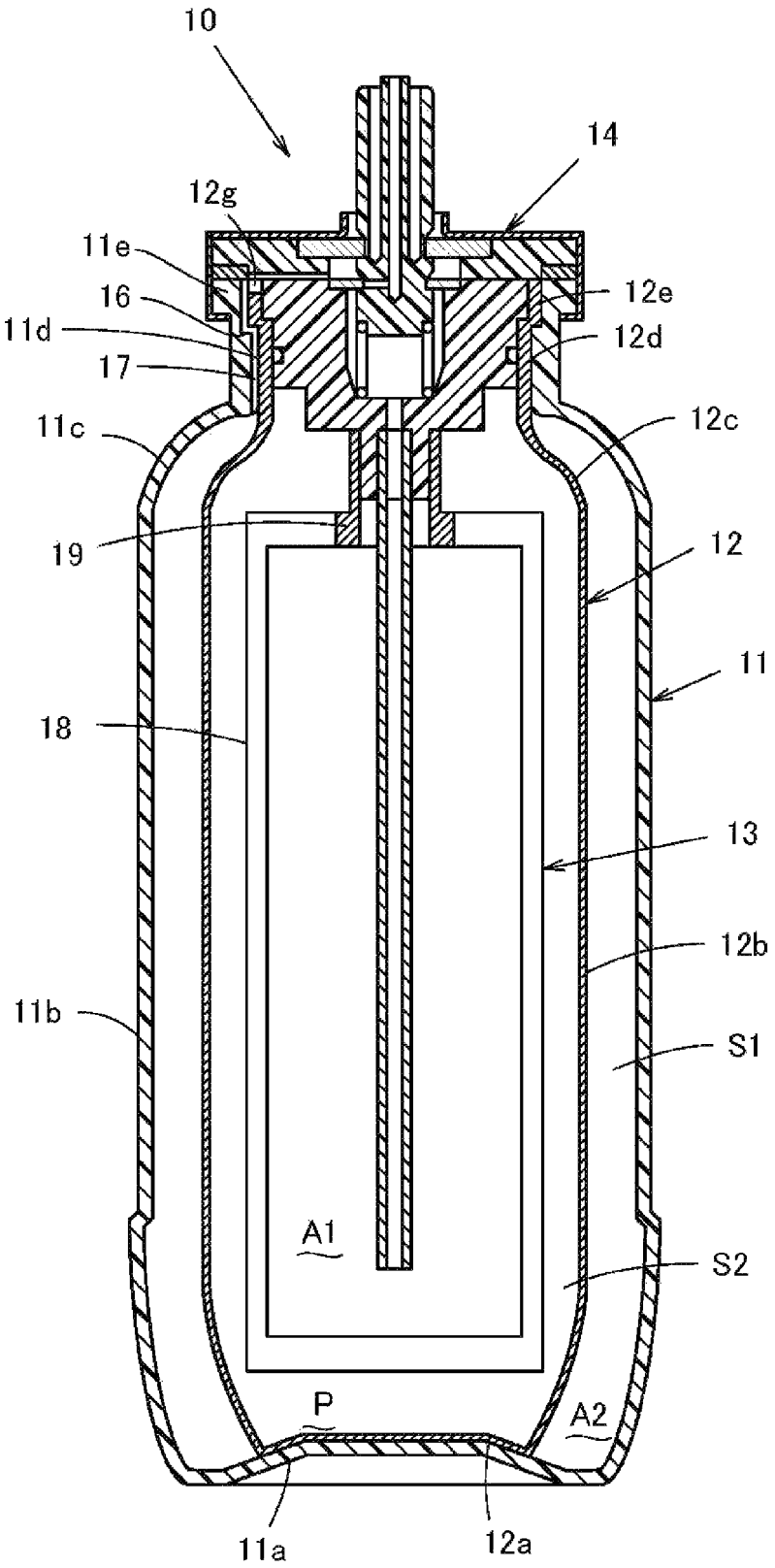
FIG. 1 A cross sectional view showing an embodiment of the two liquid dispenser of the present invention.

A two liquid dispenser 10 of FIG. 1 is equipped with a pressure resistant container 11, an intermediate container 12 which has flexibility and which is housed in the pressure resistant container, a pouch 13 which is housed in the intermediate container 12, a valve assembly 14 which closes the pressure resistant container 11, the intermediate container 12, and the pouch 13, a first content A1 which is stored in the pouch 13, a second content A2 which is stored in a first space S1 formed between the pressure resistant container 11 and the intermediate container 12, a propellant P which is charged in a second space S2 formed between the intermediate container 12 and the pouch 13.

The pressure resistant container 11 is a synthetic resin container and has a bottom portion 11*a*, a tubular barrel portion 11*b*, a tapered shoulder portion 11*c*, a tubular neck portion 11*d*, and a thick flange portion 11*e* formed on the top of the neck portion, as shown in FIG. 1. A step portion 16 narrowing in a downward direction is formed on the inner surface of the neck portion 11*d* or the flange portion 11*e*. Plural of an inner channel 17 extending in vertical direction is formed and arranged annularly on the inner surface of the neck portion 11*d* and the flange portion 11*e*.

The pressure resistant container 11 is formed by two axis stretching blow molding which stretches the parison in axis direction and in width direction by charging the air inside. The bottomed cylindrical parison is made of synthetic resin having translucency, for example, polyester such as polyethylene-terephthalate, polycyclohexane-dimethylene-terephthalate, polyamide such as nylon, polyolefin such as polyethylene, polypropylene. However, the cylindrical parison may be formed by direct blow molding. In the case where the pressure resistant container is translucent, it is preferable because the remaining amount and the condition of the content can be verified. The pressure resistant container 11 may be colored or the synthetic resin may include the ultraviolet absorber agent to improve the stability of the content. But, it may be formed from metal such as aluminum, tin plate, stainless steel, and etc.

The intermediate container 12 before the charging of the second content A2 abuts with the inner surface of the pressure resistant container 11, which means that the shape of the intermediate container 12 before the charging of the second content A2 is substantially same or approximately same as the inner surface of the pressure resistant container. The intermediate container is compressed by charging the second content A2. The intermediate container 12 of FIG. 1 is somewhat compressed. The intermediate container 12 is a synthetic resin container with flexibility and has a bottom portion 12*a*, a cylindrical barrel portion 12*b*, a tapered shoulder portion 12*c*, a cylindrical neck portion 12*d* and a mouth portion 12*e* somewhat extended in radial direction than the neck portion 12*d*. The intermediate container 12 can also be formed by two axis stretching blow molding which stretches the parison in axis direction and in width direction by charging the air inside. The bottomed cylindrical parison is made of synthetic resin, for example, polyester such as polyethylene terephthalate, polycyclohexane dimethylene terephthalate, polyamide such as nylon, polyolefin such as polyethylene, polypropylene. Specifically it may be simultaneously formed with the pressure resistant container by blow molding the parison of the intermediate container in the parison of the pressure resistant container. The neck portion 12*d* and the mouth portion 12*e* are formed to be thicker than the barrel portion 12*b*. A notch 12*g* is formed at the top of the mouth portion 12*e* of the intermediate container 12, so as to communicates the inner channel 17 of the pressure resistant container and the communicating channel 28*c* described below. However, a channel extending vertically may be formed on the outer surface of the neck portion 12*d* and the mouth portion 12*e* and form outer channel between the neck portion 11*d* and the flange portion 11*e* of the pressure resistant container. Further, the inner surface of the neck portion 12*d* and the mouth portion 12*e* of the intermediate container is structured so as to tightly fit with the outer surface of the housing of the valve assembly 14 described below.

The pouch 13 has a flexible bag body 18 and the fixing member 19 which is fixed on the opening. The bag body 18 is formed by fixing the periphery of the sheet after piling two sheets or after folding one sheet. The bag body 18 may be translucent. It is determined according to the content to be stored or to the usage.

As for the sheet of the bag body 18, a single layer or laminated synthetic resin sheet made of synthetic resin, such as polyethylene (PE), polypropylene (PP), polyethylene-terephthalate (PET), nylon (NY), or eval (EVOH); a colored synthetic resin sheet formed by coloring said synthetic resin sheet; a vapor deposited synthetic resin sheet formed by vapor depositing silica (Si), alumina (Al2O3), or carbon (C) or etc to said synthetic resin sheet; a metal foil sheet such as aluminum foil (Al foil); or a laminated sheet formed by laminating at least two sheets selected from said synthetic resin sheet, said colored synthetic resin sheet, said vapor deposited synthetic resin sheet, or said metal foil sheet, may be listed. Especially, the metal foil sheet or the laminated sheet including the metal foil sheet is preferable, because it can store the content stably. For such the laminated sheet including metal foil sheet, such as PE/A1 foil/PE, PE/A1 foil/PET, PE/A1 foil/PET/PE, a laminated sheet formed by laminating the metal foil sheet with the synthetic resin sheet, or vapor deposited synthetic resin sheet are preferable.

Figure 2:
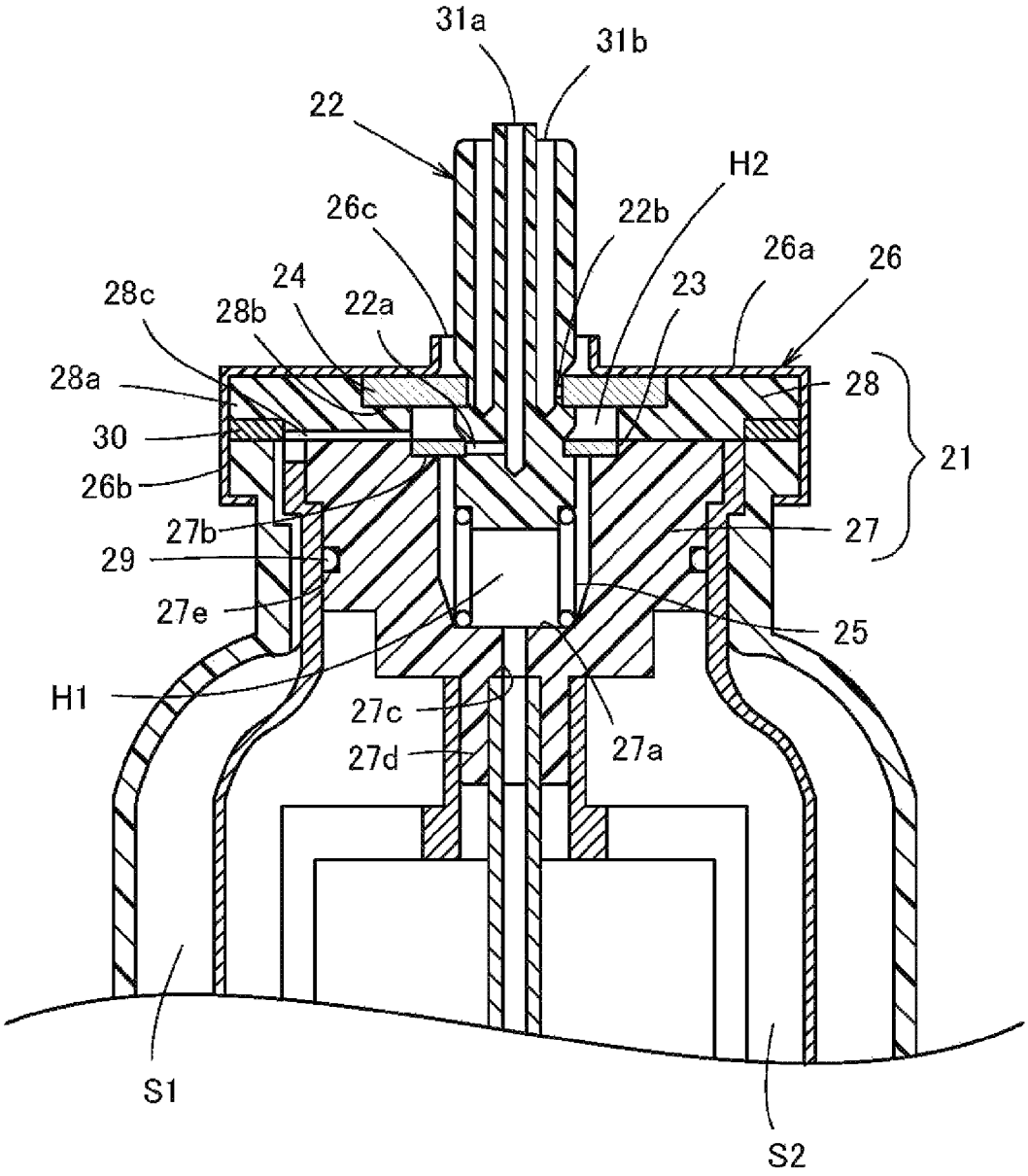
FIG. 2 An enlarged view showing the main part of FIG. 1.

The valve assembly 14 is equipped with a valve structure which independently communicates each of the first space S1 and the inside of the pouch 13 with the outside, and seals the second space S2. Specifically, like shown in FIG. 2, it has a tubular housing 21, a stem 22 movably housed in the housing in vertical direction and having two independent stem holes of a lower stem hole 22*a* and an upper stem hole 22*b*, a first stem rubber 23 closing the lower stem hole 22*a* of the stem, a second stem rubber 24 closing the upper stem hole 22*b* of the stem, a spring 25 which always energized the stem upward, and a cover 26 which covers the whole of the housing 21 and which fix the housing 21 with the pressure resistant container 11.

The housing 21 is composed of a tubular lower member 27, an upper member 28 which is coupled concentrically to the top of the lower member, an O-ring 29 held on the lower member 27, and a gasket 30 held on the upper member 28. The lower member 27 is equipped with a bottom 27*a* supporting the spring 25, a first stepped portion 27*b* which is formed on the inner surface and which holds the first stem rubber 23, a communicating path 27*c* penetrating the bottom 27*a*, and a tubular joining portion 27*d* which protrudes downwardly from the bottom 27*a*. In the inside of the joining portion 27*d*, a dipping tube 30*a* extending to the inside of the pouch is inserted. On the outside of the joining portion 27*d*, the fixing member 19 of the pouch 13 is connected. Therefore, the communicating path 27*c* communicates the inside of the lower member and the inside of the pouch 13.

Further, on the outer surface of the lower member 27, an annular channel which holds an O-ring 29 sealing the second space S2, is formed. Because, the neck portion 12*d* of the intermediate container 12 is formed to be somewhat thick, the sealing function of O-ring 29 can be obtained securely.

The upper member 28 is coupled concentrically to the top surface of the lower member 27, and equipped with a flange portion 28*a* which is formed on the top of the outer surface and which is protruded in radial direction, a second step portion 28*b* which is formed on the inner surface and which holds the second stem rubber 24, and a communicating channel 28*c* which is formed on the lower surface and which communicates the inside and the outside. The communicating channel 28*c* may be formed plurally and arranged annularly. The gasket 30 is held so as to contact with the lower surface of the flange 28*a*. Moreover, the upper member 28 and the lower member 27 of the housing 21 maybe integrally formed like shown in housing 73 of FIG. 7.

The stem 22 has a lower stem hole 22*a* and an upper stem hole 22*b*, which are independently formed in up and down position. Each of the stem holes 22*a*, 22*b* communicates with the outside through a first stem path 31*a* and a second stem path 31*b*, respectively.

The first stem rubber 23 and the second stem rubber 24 are a ring shaped sealing member in which the stem 22 is inserted, and which are positioned to block the upper and lower stem holes 22*a*, 22*b*, respectively.

The cover 26 have a cover portion 26*a* covering the housing 21, and a fixing portion 26*b* which nips the flange 28*a* of the housing 21 and the flange 11*e* of the pressure resistant container 11 and which is swaged against the lower surface of the flange 11*e* of the pressure resistant container 11. On the top surface of the cover position 26*a*, the center hole 26*c* passing the stem 22 is formed.

In the valve assembly 14, a first valve interior space H1 is formed between the lower member 27 of the housing 21 and the first stem rubber 23, and a second valve interior space H2 is formed between the first stem rubber 23 and the second stem rubber 24. By lowering the stem 22 of the valve assembly 14, the lower stem hole 22*a* and the upper stem hole 22*b* of the stem 22 are opened. Then the first content A1 housed in the pouch 13 is provided to the first valve interior space H1 through the dipping tube 30*a* and communicating path 27*c* and dispensed outside through the lower stem hole 22*a* and the first stem path 31*a*. On the other hand, the second content A2 housed in the first space S1 is provided to the second valve interior space H2 through the inner channel 17 of the pressure resistant container 11, the notch 12*g* of the intermediate container, and the communicating channel 28*c*, and dispensed outside through the upper stem hole 22*b* and the second stem path 31*b*. This valve assembly 14 enables to independently and simultaneously dispense the first content A1 and the second content A2 which are housed independently, by only one operation of lowering the stem 22. However, the valve assembly may be configured to have the two contents mixed inside. Further, it may includes two independent valve structure which are to be operated in different handling like the valve assembly of FIG. 8.

The specific of the first content A1 and the second content A2 is not limited. However, it is preferable to be used in the two liquid reaction type formula, in which the effect can be obtained by mixing two liquid, such as two liquid type hair dye, two liquid type permanent, and etc. Especially, when it is two liquid type hair dye, for the first content A1, a first hair dye agent solved in the solvent is used, in which the first hair dye includes an oxidation dye, a hair dye auxiliary ingredient, an alkaline agent including an ammonia, an organic amine and etc., a stabilizing agent, a viscosity conditioning agent, a foaming agent (a surface acting agent), an other effective ingredient which produces effect other than hair dye, oil ingredient, and etc. For the second content A2, a second hair dye agent solved in the solvent is used, in which the second content A2 includes an oxidant including a hydrogen peroxide and etc., a pH conditioning agent, a stabilizing agent, a viscosity conditioning agent, a foaming agent (a surface acting agent), an other effective ingredient which produces effect other than hair dye, oil ingredient, and etc.

For the propellant P, a compressed gas such as nitrogen, a compressed air, carbon dioxide, dinitrous monoxide, and etc., and a liquefied gas such as liquefied petroleum gas, dimethyl ether, hydro-fluoro-olefin, and etc. may be cited.

For the manufacturing method of this two liquid dispenser 10, for example, a parison of the pressure resistant container and the intermediate container may be formed by injection molding, two-layered parison is formed by inserting the parison of the intermediate container into the parison of the pressure resistant container, and both the pressure resistant container 11 and the intermediate container 12 are formed by blow molding at once. After that, the second content A2 is charged into the first space S1 from the gap between the flange portion 11*e* of the pressure resistant container 11 and the mouth portion 12*e* of the intermediate container 12 through the inner channel 17. Further, the propellant P is charged into the second space 12 from the gap between the intermediate container 12 and the valve assembly 14 (specifically, the space between the pressure resistant container 11 and the housing 21 through the intermediate container 12 and the housing 21), while inserting the valve assembly 14, in which the pouch 13 is attached, into the intermediate container 12. At the same time or just after the charging of the propellant P, a bottom portion of the fixing portion 26*b* of the cover 26 is swaged, the valve assembly 14 is fixed to the pressure resistant container 11, and the first space S1 and the second space S2 is sealed. In addition, the air in the pouch 13 is ejected with sealing the second stem path 31*b*, and the first content A1 is charged into the pouch 13. Furthermore, the pressure resistant container 11 and the intermediate container 12 may be formed, by first forming the pressure resistant container 11 by blow-molding, and forming the intermediate container 12 thereafter by inserting the parison of the intermediate container and by blow-molding in the pressure resistant container.

For the other manufacturing method, the pressure resistant container 11 and the intermediate container 12 are formed from the two-layered parison by blow-molding, and the valve assembly 14, in which the pouch 13 is attached, is inserted into the intermediate container 12. At the same time, the propellant P is charged into the second space S2 from the space between the intermediate container 12 and the valve assembly 14 (specifically, the space between the pressure resistant container 11 and the housing 21 through the intermediate container 12 and the housing 21). Further, at the same time or just after the charging of the propellant P, a bottom portion of the fixing portion 26*b* of the cover 26 is swaged, the valve assembly 14 is fixed to the pressure resistant container 11, and the first space S1 and the second space S2 is sealed. After that, the air in the first space S1 and the pouch 13 is ejected by lowering the stem 22. Lastly, the second content A2 is charged from the second stem path 31*b* communicating the first space S1, and the first content A1 is charged from the first stem path 31*a* of the stem 22 communicating the pouch 13.

In the two liquid dispenser 10, the propellant P charged into the second space S2 compresses the first space S1 (the intermediate container expand) and the pouch 13, therefore contents charged in each space are discharged at the same time, by opening the valve assembly 14. Especially, because the intermediate container 12 and the inner surface of the pressure resistant container is formed in substantially same shape (approximately same shape), the second content A2 in the first space S1 can be discharged without a loss. On the other hand, because the pouch 13 is made by overlapping two sheets, the first content A1 can be also discharged without a loss. Especially, because the propellant P directly compresses the pouch and the first space, the pressure of the propellant is equally assigned to the first content and the second content, resultantly the ratio of the discharged amount of both contents is stable.

Figure 3:
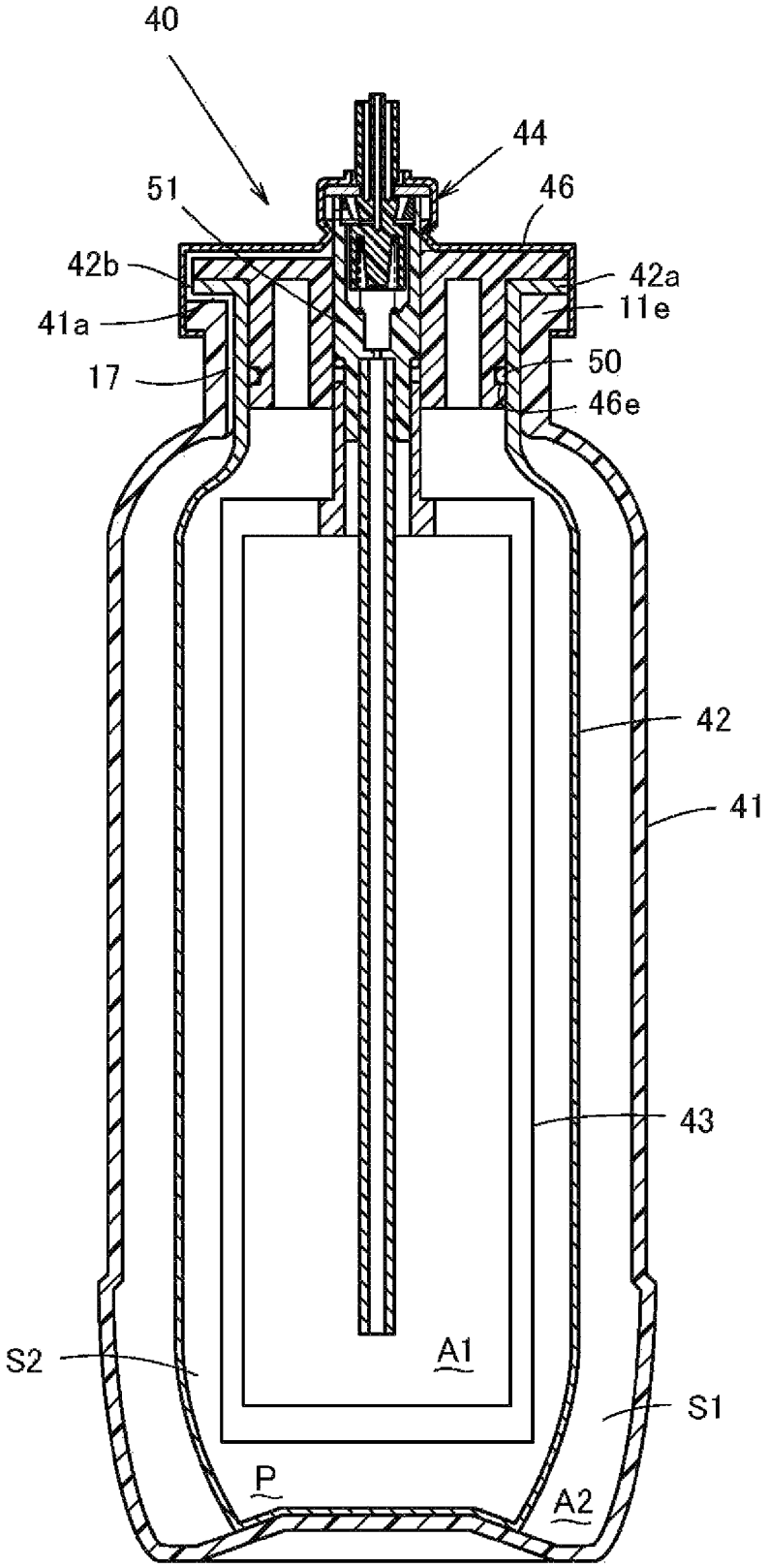
FIG. 3 A cross sectional view showing another embodiment of the two liquid dispenser of the present invention.

The two liquid dispenser 40 of FIG. 3 is equipped with the pressure resistant container 41, the flexible intermediate container 42 housed in the pressure resistant container, the pouch 43 housed in the pressure resistant container, the valve assembly 44 closing the pressure resistant container 41, the intermediate container 42, and the pouch 43, the first content A1 stored in the pouch, the second content A2 stored in the first space S1 formed between the pressure resistant container 41 and the intermediate container 42, and the propellant charged in the second space S2 formed between the intermediate container 42 and the pouch.

The pressure resistant container 41 has the bottom, the barrel portion, the shoulder portion, the neck portion, and the flange portion like the pressure resistant container 11 of FIG. 1. The plural of groove extending from the upper surface of the flange 11*e* in the upper channel 41*a* to the inner surface of the neck portion 11*d* in channel 17 are formed and arranged annularly. Further, the pressure resistant container 41 is different with the pressure resistant container 11 of FIG. 1, in that there is no step portion on the neck portion or the flange portion. Other configuration is substantially same as the pressure resistant container 11 of FIG. 1.

The intermediate container 42 has the same shape with the intermediate container 12 of FIG. 1, in which the outer surface of the intermediate container abuts to the inner surface of the pressure resistant container 11 before the second content A2 is charged. In other word, the intermediate container 42 has the substantially same shape (approximately same shape) as the inner surface of the pressure resistant container, and is compressed by charging the second content A2. The intermediate container 42 has the bottom portion, the barrel portion, the shoulder portion, the neck portion and the flange portion 42*a* protruding in radial direction from the top of the neck portion. And plural of slit 42*b* are formed and arranged annularly on the outer edge of the flange portion 42*a*. The slit 42*b* is formed on the same position as the inner channel 17 of the pressure resistant container 11. However, it may be designed to have the outer edge of the flange portion 42*a* formed some what inside than the flange 11*e* of the pressure resistant container. The intermediate container 42 is different with the intermediate container 12 of FIG. 1 in that it has no mouth portion and has the flange portion 42*a*. Further, a channel may be formed on the outer surface of the neck portion of the intermediate container and the under surface of the flange portion 42*a*, so as to form the outer groove between the intermediate container and the inner surface of the neck portion of the pressure resistant container and the flange 11*e*.

The pouch 43 is substantially same as the pouch 13 of FIG. 1.

The valve assembly 44 has the valve structure which independently communicates the outside with the first space S1 and the inside of the pouch, and seals the second space S2, like the valve assembly of FIG. 1. The valve assembly 44 is equipped with the valve holder 46, and the valve 47 held by the valve holder.

Figure 4:
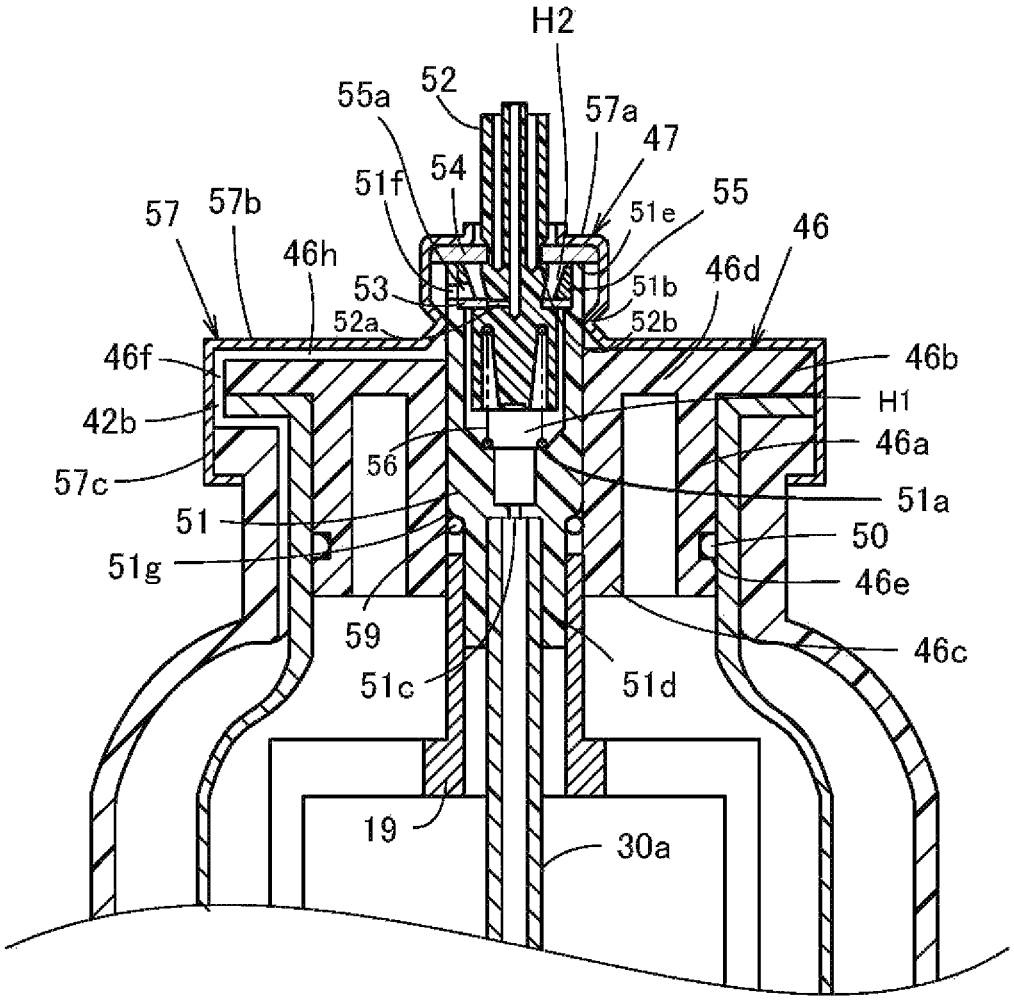
FIG. 4 An enlarged view showing the main part of FIG. 3.

The valve holder 46, as shown in FIG. 4, is composed of a tubular annular wall 46*a*, a flange portion 46*b* formed on the top of the annular wall protruding in radial direction, a tubular valve holding wall 46*c* which has smaller diameter than the annular wall 46*a* and which is formed concentrically with the annular wall 46*a*, and a joint portion 46*d* jointing the annular wall 46*a* and the valve holding wall 46*c*. The annular wall 46*a* is a portion which nips the neck portion of the intermediate container 42 with the pressure resistant container 41 and has the annular groove 46*e* formed on the outer surface for holding the O-ring 50 sealing the second space S2. Further, the notch 46*f* is formed on the outer edge of the flange portion 46*b* and the communicating channel 46*h* is formed on the upper surface of the flange 46*d* in radial direction continuous with the notch 46*f*. The notch 46*f* is positioned so as to form a path extending up and down with the slit 42*b* of the flange 42*a* of the intermediate container. The tubular valve holding wall 46*c* holds the housing which is described later by inserting the housing inside.

The valve 47 is equipped with a tubular housing 51, a stem 52 which is housed in the housing movably in vertical direction and which has a lower stem hole 52*a* and an upper stem hole 52*b* independently formed in up and down position, a first stem rubber 53 closing the lower stem hole of the stem, a second stem rubber 54 closing the upper stem hole of the stem, a supporting member 55 which supports the first stem rubber 53 and the second stem rubber 54, a spring 56 which always energizes the stem 52 upward, and a cover 57 which covers the housing 51 and which fixes the housing 51 to the valve holder 46. The cover 47 also fixes the valve 47 and the valve holder 46 to the pressure resistant container 41.

The housing 51 is composed of a bottom portion 51*a* supporting the spring 56, a first step portion 51*b* which is formed on the inner surface and which holds the first stem rubber 53, a communicating path 51*c* penetrating the bottom portion 51*a*, a tubular joint portion 51*d* which protrude downwardly from the bottom portion 51*a*, a second step portion 51*e* which is formed on the inner surface and which holds the second stem rubber 54, and a side communicating hole 51*f* which is formed on the upper part of the lateral wall and which communicates the inside and the outside of the housing. The dipping tube 30*a* is inserted in the inside of the joint portion 51*d* to be coupled, and the fixing member 19 of the pouch 13 is coupled on the outside. Therefore, the communicating path 51*c* communicates the inside of the housing 51 and the inside of the pouch 13. Further, an annular step portion 51*g* is formed between the bottom portion 51*a* and the joint portion 51*d* for holding the O-ring 59 which seals the second space S2.

The stem 52, the first stem rubber 53, the second stem rubber 54, and the spring 54 are substantially same as the members of the valve assembly 14 of FIG. 1.

The supporting member 55 is a tubular member which is positioned between the first stem rubber 53 and the second stem rubber 54 and which is for supporting the first stem rubber 53 and the second stem rubber to deform in stable shape when the stem 52 is lowered. Further, there is a penetrating hole 55*a* for communicating the lateral communicating hole 51*f* with the inside of the supporting member 55.

The cover 57 is composed of a valve holding part 57*a*, a tubular cover part 57*b* covering valve holder, and a fixing part 57*c* which nips the flange 46*b* of the valve holder and the flange 11*e* of the pressure resistant container 11 and which is swaged to the under surface of the flange portion 11*e* of the pressure resistant container 11. On the top surface of the valve holding part 57*a*, there is a center hole for passing the stem 52. In addition, in this embodiment the inner surface of the cover may be decomposed by contacting with the second content A2, therefore it is preferable to laminate the inner surface of the cover by synthetic resin sheet such as polyethylene terephthalate, nylon, and etc, or to coat the synthetic coating film by applying and drying the synthetic resin solution such as polyamide imide, epoxy phenol and etc.

In the valve 47 of the valve assembly 44, the first valve interior space H1 is formed by the housing 51 and the first stem rubber 53, and the second valve interior space H2 is formed by the housing 51, the first stem rubber 53, and the second stem rubber 54. The lower stem hole 52*a* and the upper stem hole 52*b* are opened by lowering the stem 52 of the valve assembly 44. And the first content A1 in the pouch 13 is provided to the first valve interior space H1 through the dipping tube 30*a* and the communicating path 51*c*, and is discharged outside through the lower stem hole 52*a*, the first stem path 31*a*. On the other hand, the second content A2 charged in the first space S1 is provided to the second valve interior space H2 through the inner channel 17 of the pressure resistant container 11, the upper channel 41*a*, the slit 42*b* of the intermediate container 42, the cut line 46*f* of the valve holder, the communicating channel 46*h*, and the side communicating hole 51*f* of the valve 47, and is discharged outside through the upper stem hole 52*b* and the second stem path 31*b*.

For the first content A1, the second content A2, and the propellant P, substantially same agent as the two liquid dispenser 10 of FIG. 1 may be applied.

Because the two liquid dispenser 40 is configured like above, the first content A1 and the second content A2 are stored adjacent to the propellant P, and receives equivalent pressure from the propellant like the two liquid dispenser 10 of FIG. 1. Further, it has high durability, because the first content A1 and the second content A2 can not penetrate to the other content without going through the second space S2 (propellant P). Moreover, the remaining amount of the first content A1 and the second content A2 after the usage may be held low.

Figure 5:
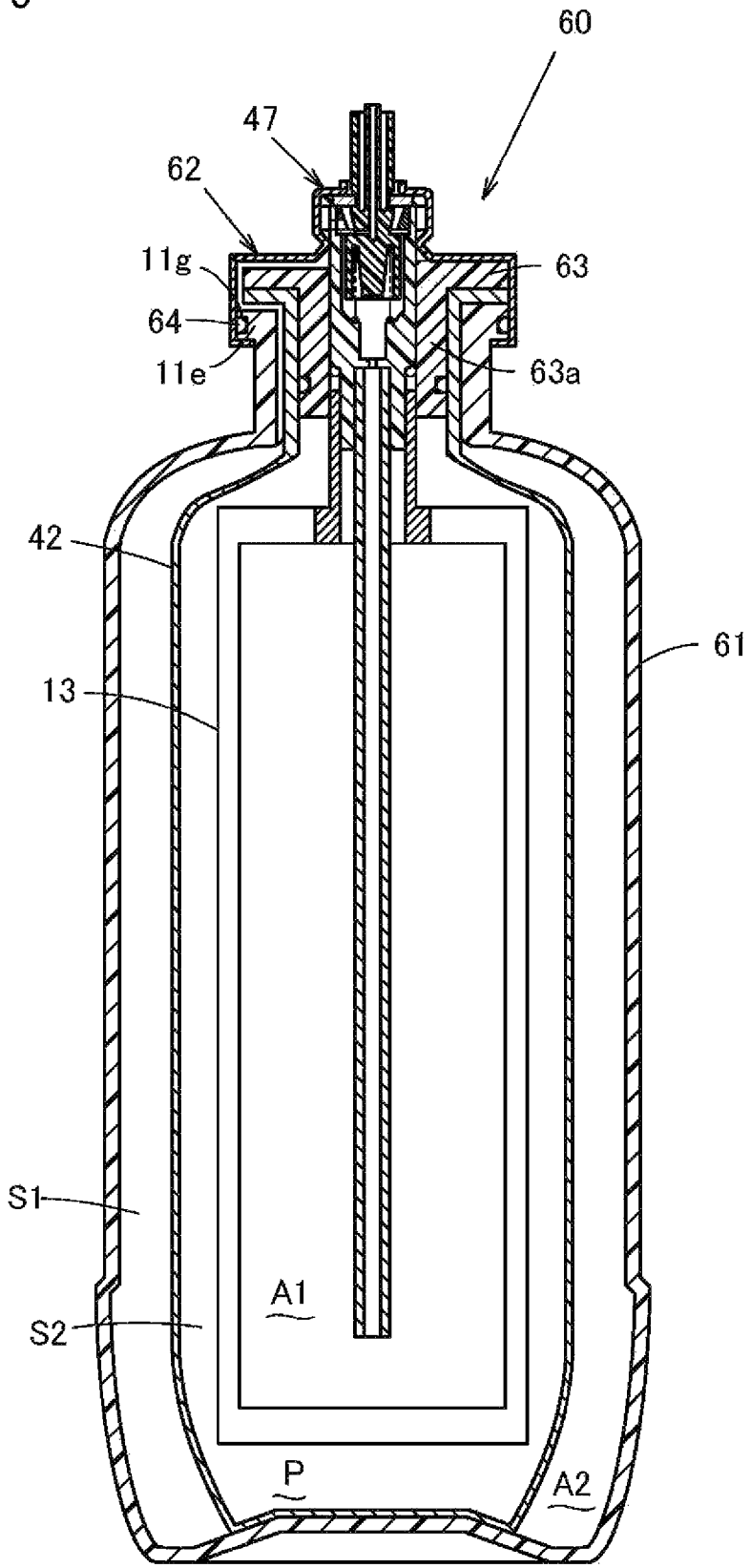
FIG. 5 A cross sectional view further showing another embodiment of the two liquid dispenser of the present invention.

The two liquid dispenser 60 of FIG. 5 is equipped with the pressure resistant container 61, the intermediate container 42, the pouch 13, the valve assembly 62, the first content A1 stored in the pouch, the second content A2 stored in the first space S1 formed between the pressure resistant container 61 and the intermediate container 42, and the propellant P charged in the second space S2 formed between the intermediate container and the pouch.

The pressure resistant container 61 is substantially same as the pressure resistant container of the two liquid dispenser 40 of FIG. 3 except for the points that the diameter of the opening of the pressure resistant container 61 is smaller than the pressure resistant container 11 of FIG. 1, that the tubular annual wall 63*a* of the valve holder 63 of the valve assembly 62 has the inner surface which holds the housing 51 of the valve 47, and that the O-ring 64 is positioned on the annular groove 11*g* formed on the outer surface of the flange portion 11*e* of the pressure resistant container 61. The other structure is substantially same as the two liquid dispenser 40 of FIG. 3, and the same effects are to be obtained. Further, the width of the annular wall of the valve holder or gap between the valve holding wall may be adjusted according to the inner diameter of the neck portion of the pressure resistant container 62 and the intermediate container 42.

Figure 6:
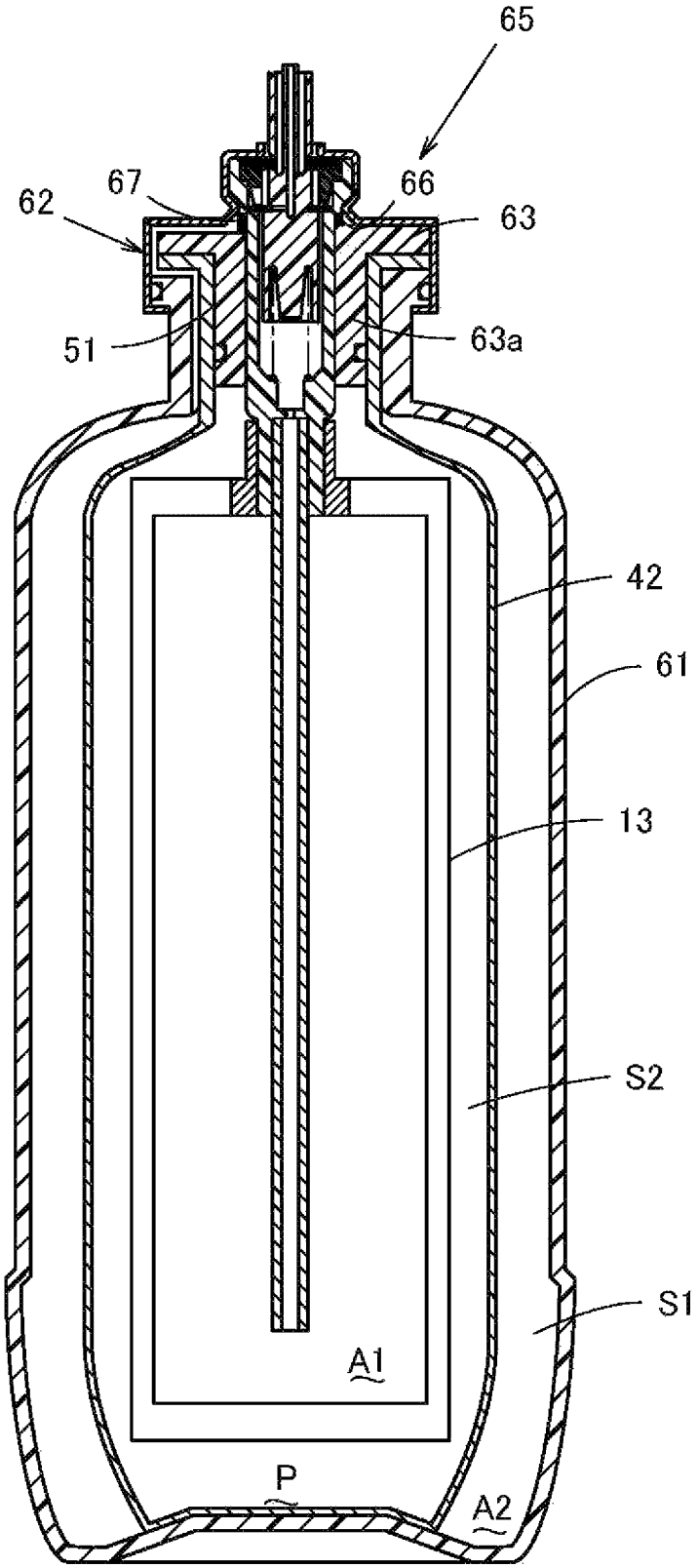
FIG. 6 A cross sectional view further showing another embodiment of the two liquid dispenser of the present invention.

The two liquid dispenser 65 of FIG. 6 is equipped with the pressure resistant container 61, the intermediate container 42, the pouch 13, the valve assembly 62, the first content A1 stored in the pouch, the second content A2 stored in the first space S1 formed between the pressure resistant container 61 and the intermediate container 42, and the propellant P charged in the second space S2 formed between the intermediate container and the pouch.

The two liquid dispenser 65 of FIG. 6 differs from the two liquid dispenser 60 of FIG. 5, in the sealing structure between the valve holder 63 and the housing 51 of the valve 47. In the sealing structure, the step portion 66 is formed on the outer surface of the housing 51 of the valve 47 in which the diameter is reduced downwardly, and the step portion 66 mates the upper surface of the valve holder 63 through the annular gasket 67. The other configuration is substantially same as the two liquid dispenser 60 and the same effect can be obtained.

Figure 7:
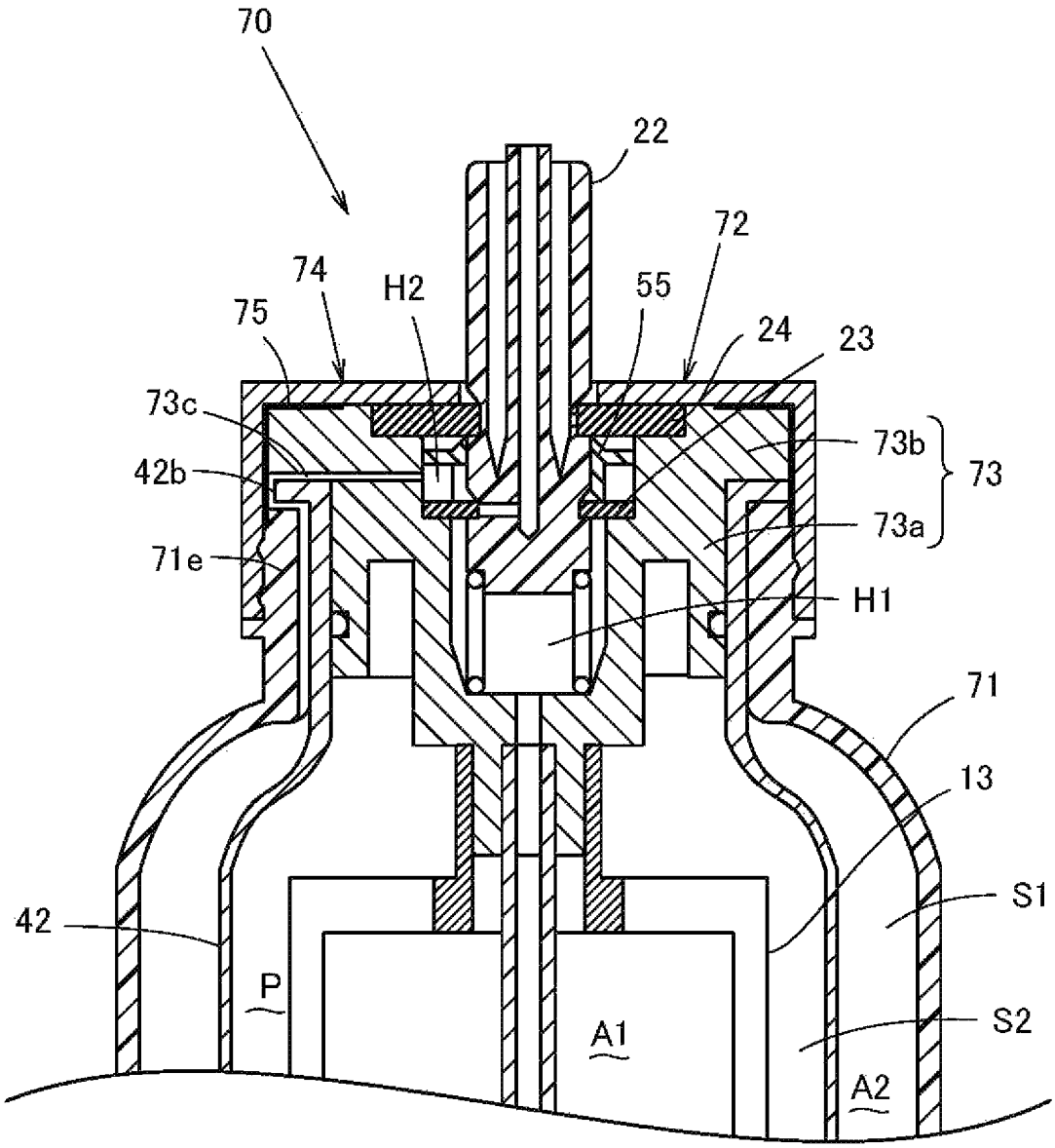
FIG. 7 A cross sectional view further showing another embodiment of the two liquid dispenser of the present invention.

The two liquid dispenser 70 of FIG. 7 is equipped with the pressure resistant container 71, the intermediate container 42, the pouch 13, the valve assembly closing the pressure resistant container 71, the intermediate container 42, and the pouch 13, the first content A1 stored in the pouch, the second content A2 stored in the second space S2 formed between the pressure resistant container 71 and the intermediate container 42, and the propellant P charged in the first space S1 formed between the intermediate container 42 and the pouch. The pouch 13, the first content A1, the second content A2, and the propellant P are substantially same as those of FIG. 1, and the intermediate container 42 is substantially same as that of FIG. 3.

The pressure resistant container 71 has a male thread formed on the outer surface of the mouth portion 71*e*, and the other structures are substantially same as those of the pressure resistant container 11 of FIG. 1.

The valve assembly 72 is equipped with the tubular housing 73, the stem 22, the first stem rubber 23, the second stem rubber 24, the spring 25, the supporting member 55 which is positioned between the first stem rubber 23 and the second stem rubber 24 and which fixes the stem rubbers in the housing 73, and the lid member 74 which covers the housing 73 and which fix the housing 73 to the pressure resistant container 71. The stem 22, the first stem rubber 23, the second stem rubber 24, and the spring 25 are substantially same as those of valve assembly 14 of FIG. 1, and the supporting member 55 is substantially same as supporting member 55 of FIG. 4.

The housing 73 is composed of the tubular main body 73*a*, and the flange portion 73*b* formed on its top. On the upper outer surface of the main body 73*a*, the communicating hole 73*c* is formed to communicates the inside and the outside of the main body. This communicating hole 73*c* is formed to communicate the second valve interior space H2 formed between the first stem rubber 23 and the second stem rubber 24 with the slit 42*b* of the flange 42*a* of the intermediate container. Therefore, the first space S1 and the second valve interior space H2 are communicated through the inner channel 17 of the pressure resistant container 71, the upper channel 41*a* of the pressure resistant container 71, the slit 42*b* of the intermediate container, and the communicating hole 73*c* of the housing.

The lid member 74 has the female thread formed on bottom of the inner surface which screws with the male thread of the pressure resistant container 71, and equipped with the tubular sealing member 75 having ceiling. The sealing member 75 contacts with the upper surface of the housing 73, the outer surface of the housing 73, and the top of the outer surface of the mouth portion 71*e* of the pressure resistant container 71. However, in the sealing member 75, the ceiling may be omitted and the sealing member 75 may not have to mates with the upper surface of the housing 73.

In this two liquid dispenser 70, after the pressure resistant container 11 and the intermediate container 42 are formed at the same time, the lid member 74 attached to the housing 73 is temporally fixed to the mouth portion 71*e* of the pressure resistant container or temporally positioned above the mouth portion 71*e* of the pressure resistant container. At this point, the main body 73*a* of the housing is not fitted to the neck portion of the intermediate container, and the sealing member 75 is not in contact with top outer surface of the mouth portion 71*e*. Therefore, gap to charge the propellant into the second space S2 is formed between the neck portion of the intermediate container 42 and the housing 73.

Further, by screwing the lid member 74 after the charging of the propellant, the second space S2 is sealed by the main body 73*a* of the housing fitting with the neck portion of the intermediate container, and also seals the first space S1 formed between the pressure resistant container 71 and the intermediate container by the sealing member 75 abutting with the top outer surface of the mouth portion. Moreover, it also seals a gap between the lid member 74 and the intermediate container. Lastly, the air in the pouch 13 and the first space S1 is drained by lowering the stem 22, and the first content A1 and the second content A2 are charged through each stem path, respectively, In this case also, because the first content A1 and the second content A2 are both adjacent to propellant, they can receive equal pressure from the propellant. And because the first content A1 and the second content A2 are not adjacent, the content can not penetrate to the other without passing the propellant P, which makes the durability of the two liquid dispenser high. Because the pouch which can eliminate the inner space by pressing, is used, the remaining amount after the use can be reduced. Further, because the intermediate container has approximately same shape as the inner surface of the pressure resistant container, the first space can be substantially eliminated by the intermediate container, in which the intermediate container is pressed to the inner surface side of the pressure resistant container by propellant, and the remaining amount of the second content A2 can be reduced as much as possible.

Figure 8:
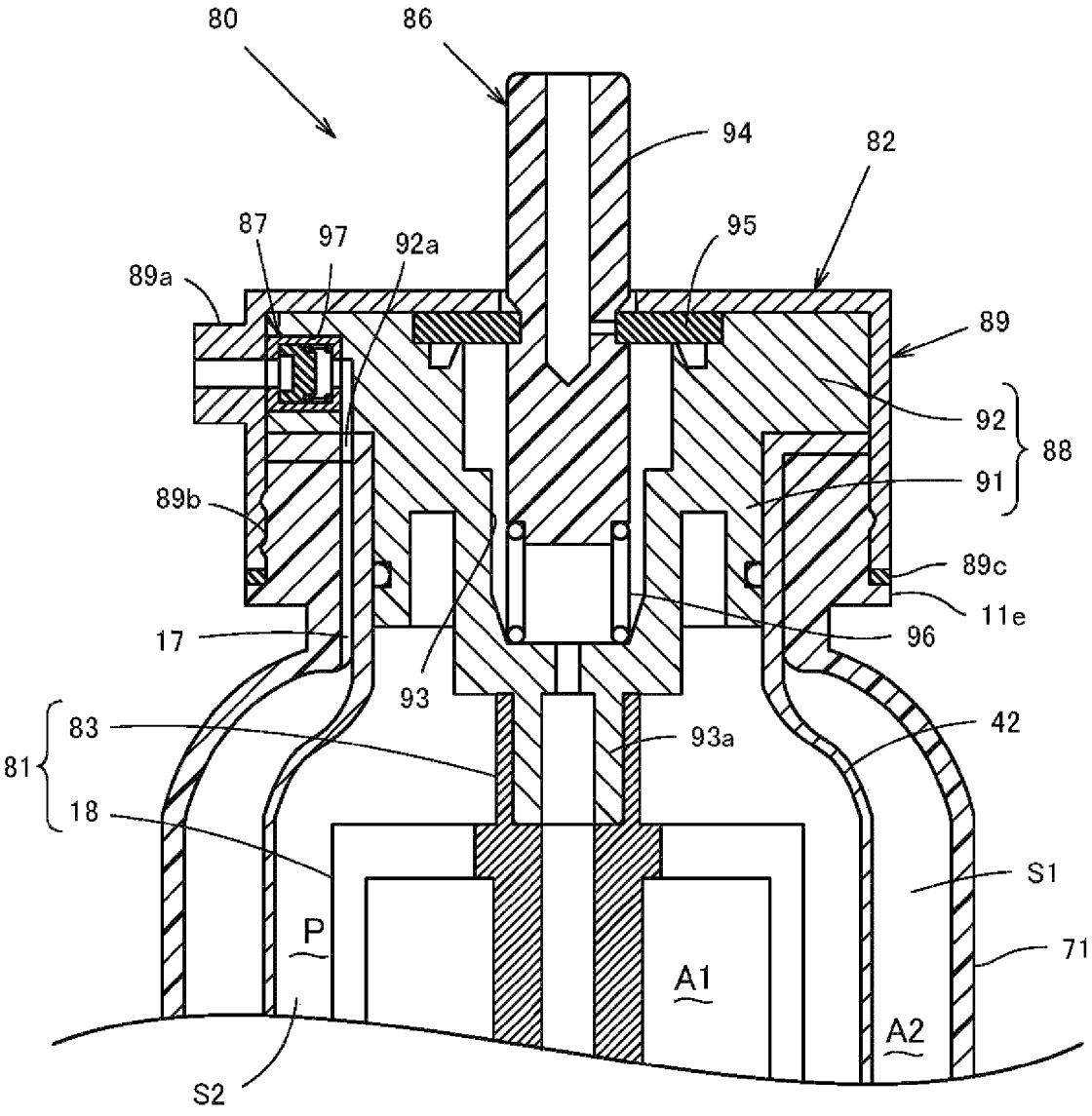
FIG. 8 A cross sectional view further showing another embodiment of the two liquid dispenser of the present invention.

The two liquid dispenser 80 of FIG. 8 has two independent valve structure, which are operated separately and which discharge the first content A1 and the second content A2 severally.

The two liquid dispenser 80 of FIG. 8, is equipped with the pressure resistant container 71, the intermediate container 42, the pouch 81, and the valve assembly 82 having two valve structure and closing the pressure resistant container 71, the intermediate container 42, and the pouch 81, the first content A1 stored in the pouch, the second content A2 stored in the second space S1 formed between the pressure resistant container 71 and the intermediate container 42, and the propellant P charged in the second space S2 formed between the intermediate container 42 and the pouch. In the two liquid dispenser 80, the first content A1, the second content A2, and the propellant are substantially same as those of FIG. 1, the intermediate container 42 is substantially same as that of FIG. 3, and the pressure resistant container 71 is substantially same as the pressure resistant container 71 of FIG. 7.

Figure 9:
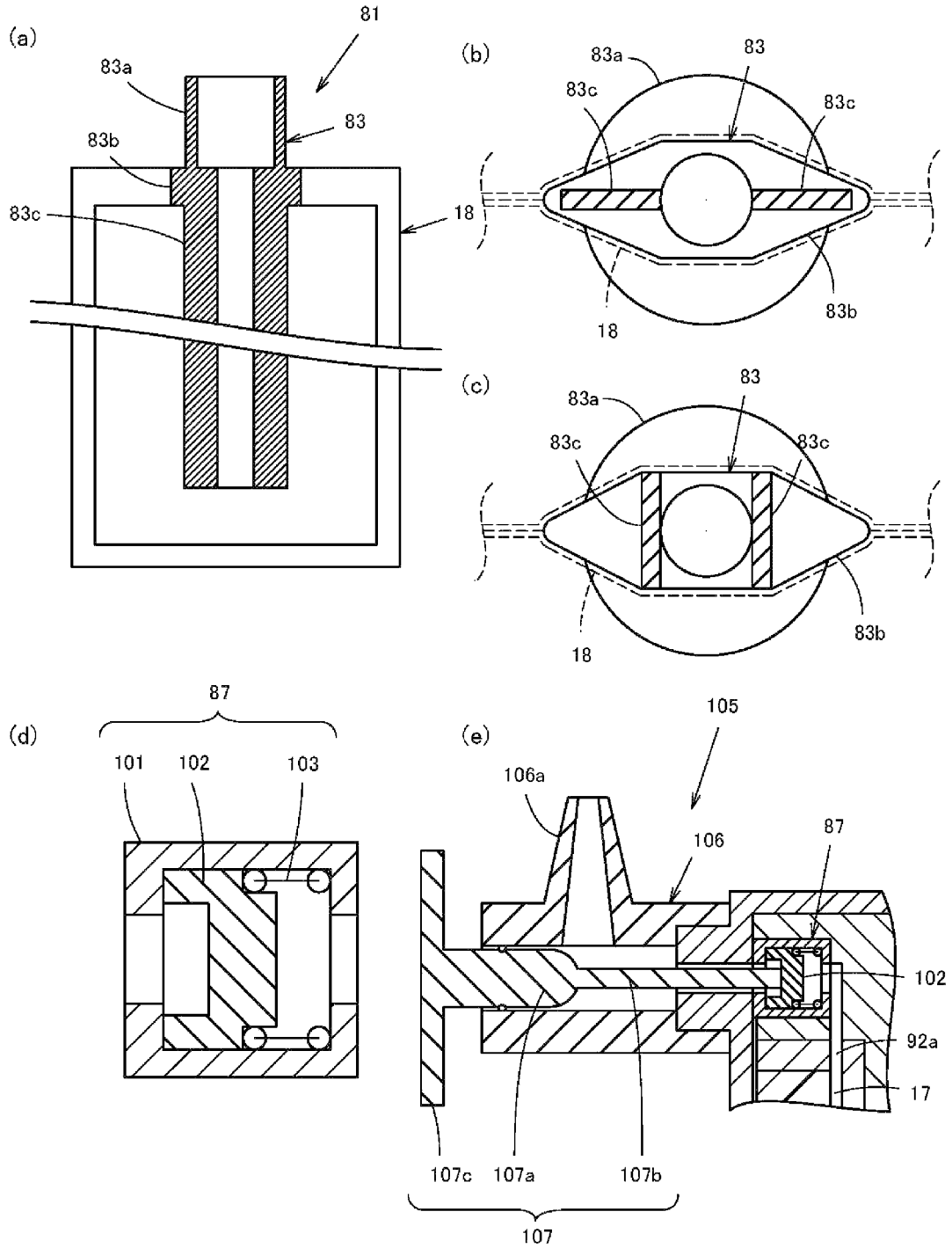
FIG. 9*a* is a side cross sectional view showing the pouch used in the two liquid dispenser of FIG. 8.
FIG. 9*b, c* are a bottom view showing connecting member which can be used to the pouch.
FIG. 9*d* shows the second valve structure.
FIG. 9*e* is a side cross sectional view showing a dispensing member which can be attached to the second valve structure of the two liquid dispenser.

The pouch 81 is equipped with the flexible bag body 18 and the fixing member 83 attached to its opening, like shown in FIG. 9*a, b*. The bag body 18 is substantially same as the bag body 18 of FIG. 1, and is formed by fixing the periphery of the sheet by welding or adhesion after piling two sheets or after folding the sheet.

The fixing member 83 is composed of the tubular upper portion 83*a* attached to the valve assembly 82, the flattened tubular lower portion 83*b* for adhering the bag body 18, and the two flat leg 83*c* extending downward from the lower portion 83*b* and provided with the interval positioning the central axis in between. The upper part of the bag body 18 is adhered to the lower portion 83*b* of the fixing member. Therefore, the two opened flat legs 83*c* prevent the sheets from contacting to secure the path of the first content A1 when the remaining amount of the first content in the pouch is lessen.

The width of the flat legs 83*c* may be set for example in similar thickness as the lower portion 83*b* of the fixing member (at least larger than the center hole of the lower portion 83*a*). In this case, the large path of the first content A1 can be secured. The flat leg 83*c* which is thickened may be adhered to the bag body 18. By adhering the flat leg 83*c* and the bag body 18, the inner space of the pouch is divided into three spaces extending in vertical direction coupled at the bottom, where the middle space connects with the valve assembly 82. In other word, the middle space functions as the dipping tube. Therefore, the first content in the pouch 81 can be securely provided to the valve assembly 81 to the end.

Back to FIG. 8, the valve assembly 82 has the first valve structure 86 which independently communicates the pouch 81 with the outside, and the second valve structure 87 which independently communicates the first space S1 with the outside, and seals the second space S2. Specifically, the valve assembly 82 is equipped with the first valve structure 86, the second valve structure 87, the plug body 88 in which the first valve structure 86 and the second valve structure is fixed, and the lid member 89 which covers the plug body 88 and which fixes the plug body 88 to pressure resistant container 71.

The plug body 88 is composed of the plug main body 91 which is inserted in the opening of the intermediate container 42, and the flange portion 92 formed on the upper outer surface and extending in radial direction.

In the center of the plug main body 91, the tubular first housing 93 penetrating the plug body in vertical direction is formed. In this first housing 93, the stem 94 movably housed in the first housing 93, the stem rubber 95 which close the opening of the first housing 93 and which close the stem hole of the stem 94, and the first spring 96 which always energize the stem 94 upward is provided. The first valve structure 86 is composed of the first housing 93, the stem 94, the stem rubber 95, and the first spring 96. Therefore, the first valve structure 86 is opened by lowering the stem 94. The first housing 93 and the pouch 81 are connected by connecting the joint portion 93*a* formed on the bottom of the housing 93, and the upper portion 93*a* of the fixing member 93 of the pouch 81.

In the flange portion 92, the tubular lateral hole 97 extending in radial direction from the periphery of the flange portion 92 to position same as the outer surface of the plug main body 91, is formed. The lateral hole 97 is communicated with the vertical communicating hole 92*a* which extends upward from the under surface of the flange 92 and which communicates with the inner channel 17 of the pressure resistant container 71. In the lateral hole 97, the tubular second housing 101 in which the front end is fold inwardly, the valve dish 102 which is movably inserted in the second housing 101 in radial direction, and the second spring 103 which always energize the valve dish in outside of the radial direction are provided. That is the second valve structure 87 is structured by the second housing 101, the valve dish 102, and the second spring 103. The second valve structure 87 is unitized by inserting the valve dish 102 and the second spring 103 into the metal tube, forming the second housing 101 by folding the front end of the metal tube inwardly. Further, the second housing 101 and the first space S1 is communicated through the vertical communicating hole 92*a* and the inner channel 17.

Back to FIG. 8, the lid member 89 is tubular member which have the ceiling and in which the penetrating tube 89*a* extending outwardly in radial direction. The penetrating tube 89*a* is formed on the position correspond to the second valve structure 87 or formed to communicate the inside to the outside of the second housing 101. Further, the lid member 89 has a female thread formed on the lower inner surface of the tube part which screw with the male thread of the pressure resistant container 71. Moreover, the annular sealing member 89*c* is provided between the bottom of the tube part of the lid member and the flange 11*e* of the pressure resistant container 71, for sealing the first space S1.

Next, dispensing member to operate the second valve structure 87 is described.

The dispensing member 105 is equipped with the tubular main body 106 which has a dispensing tube 106*a* extending outwardly in radial direction on the lateral surface thereof, and the operating part 107 which is inserted into the main body 106. In one opening of the main body 106, the penetrating tube 89*a* of the lid member 89 is inserted, and in the other opening, the operating part 107 is inserted. The operating part 107 is composed of the piston portion 107*a* which is inserted into the main body 106 with sealing the inner surface, the operating stick 107*b* protruding frontward from the piston portion 107*a*, the pressing part 107*c* formed on the back of the piston portion 107*a* and positioned on the outside of the main body 106. Therefore, the second valve structure 87 is opened by the operating stick 107*b* pushing the valve dish 102, when the operator presses the pressing part 107*c* with his finger to the main body 106 side. Resultantly, the second content A2 of the space S1 is compressed by the propellant in the space S2, is provided into the second housing 101 through the inner channel 17 and the vertical communicating hole 92*a*, and is discharged outside from the front end discharging hole of the discharging tube 106*a* of the main body 106. In this embodiment, one example of the second valve structure is shown, however its structure is not limited as long as it can push the valve dish of the second valve structure 87 by operation. Further, by designing the diameter of the stem 94 and the penetrating tube 89*a* into same, and designing the opening of the main body 106 of dispensing member to be able to attach with both stem 94 and the penetrating tube 89*a*, therefore the operator can attach the dispensing member with the stem 94 or the penetrating tube 89*a* according to the desired content to be discharge. As seen above, desired valve structure may be operated by one dispensing member. Further, as the second valve structure 87, the valve structure comprising the stem and stem rubber may be used.

DESCRIPTION OF THE NUMBERS

A1 first content
A2 second content
P propellant
S1 first space
S2 second space
H1 first valve interior space
H2 second valve interior space
10 two liquid dispenser
11 pressure resistant container
11*a* bottom portion
11*b* barrel portion
11*c* shoulder portion
11*d* neck portion
11*e* flange portion
12 intermediate container
12*a* bottom portion
12*b* barrel portion
12*c* shoulder portion
12*d* neck portion
12*e* mouth portion
12*g* notch
13 pouch
14 valve assembly
16 step portion
17 inner channel
18 bag body
19 fixing member
21 housing
22 stem
22*a* lower stem hole
22*b* upper stem hole
23 first stem rubber
24 second stem rubber
25 spring
26 cover
26*a* cover portion
26*b* fixing portion
26*c* central hole
27 lower member
27*a* bottom
27*b* first step portion
27*c* communicating path
27*d* joint portion
27*e* annular groove
28 upper member

28*a* flange portion
28*b* second step portion
28*c* communicating channel
29 O-ring
30 gasket
30*a* dipping tube
31*a* first stem path
31*b* second stem path
40 two liquid dispenser
41 pressure resistant container
41*a* upper channel
42 intermediate container
42*a* flange portion
42*b* slit
43 pouch
44 valve assembly
46 valve holder
46*a* annular wall
46*b* flange portion
46*c* valve holding wall
46*d* joint portion
46*e* annular groove
46*f* notch
46*h* communicating channel
47 valve
50 O-ring
51 housing
51*a* bottom portion
51*b* first step portion
51*c* communicating path
51*d* joint portion
51*e* second step portion
51*f* lateral communicating hole
51*g* annular step portion
52 stem
52*a* lower stem hole
52*b* upper stem hole
53 first stem rubber
54 second stem rubber
55 supporting member
55*a* penetrating hole
56 spring
57 cover
57*a* valve holding portion
57*b* cover part
57*c* fixing part
59 O-ring
60 two liquid dispenser
61 pressure resistant container
62 valve assembly
63 valve holder
63*a* annular wall
64 O-ring
65 two liquid dispenser
66 step portion
67 gasket
70 two liquid dispenser
71 pressure resistant container
71*e* mouth portion
72 valve assembly
73 housing
73*a* main body
73*b* flange portion
73*c* communicating hole
74 lid member
75 sealing member
80 two liquid dispenser
81 pouch
82 valve assembly
83 fixing member
83*a* upper portion
83*b* lower portion
83*c* flat leg
86 first valve structure
87 second valve structure
88 plug body
89 lid member
89*a* penetrating tube
89*b* female thread
89*c* sealing member
91 plug main body
92 flange portion
92*a* vertical communicating hole
93 first housing
93*a* joint portion
94 stem
95 stem rubber
96 first spring
97 lateral hole
101 second housing
102 valve dish
103 second spring
105 dispensing member
106 main body
106*a* dispensing tube
107 operating part
107*a* piston portion
107*b* operating stick
107*c* pressing part

The invention claimed is:

1. A two liquid dispenser, comprising:
a tubular pressure resistance container with a bottom,
a flexible intermediate container housed in the pressure resistance container,
a pouch housed in the intermediate container,
a valve assembly closing the pressure resistance container, the intermediate container, and the pouch,
a first content stored in the pouch,
a second content stored in a first space between the pressure resistance container and the intermediate container, and
a propellant charged in a second space between the intermediate container and the pouch,
wherein the valve assembly is equipped with a valve structure that independently connects each of the first space and an inside of the pouch with an outside of the two liquid dispenser, so that the first content and the second content are separately dispensed to the outside of the two liquid dispenser.

2. The two liquid dispenser according to claim 1,
wherein the intermediate container has an outer shape which is substantially same as an inner surface of the pressure resistance container, so that the first space is substantially eliminated by the intermediate container which receives pressure from propellant.

3. The two liquid dispenser according to claim 1,
wherein the valve assembly has a first passage which connects the pouch and the outside of the two liquid dispenser in operation, and a second passage which connects the first space and the outside of the two liquid dispenser in operation.

4. The two liquid dispenser according to claim 1,
wherein the pressure resistant container has a cylindrical neck portion, the intermediate container has a cylindrical neck portion to be inserted through the neck portion of the pressure container, and one or more vertically extending inner channels are formed in an inner surface of the cylindrical neck portion of the pressure container, so that a space or spaces between the one or more vertically extending inner channels and an outer surface of the intermediate container connects an inside of the first space with the outside of the two liquid dispenser.

5. The two liquid dispenser according to claim 1, wherein the pressure resistant container has a cylindrical neck portion, the intermediate container has a cylindrical neck portion to be inserted through the cylindrical neck portion of the pressure container, and one or more vertically extending outer channels are formed in an outer surface of the cylindrical neck portion of the intermediate container, so that a space or spaces between the one or more vertically extending outer channels and an inner surface of the pressure resilient container connects the first space with the outside of the two liquid dispenser.

6. The two liquid dispenser according to claim 1, wherein the valve assembly has an outer surface which tightly fits to an inner surface of a neck portion of the intermediate container, and the outer surface of the valve assembly is formed with an annular channel, an O-ring for sealing the second space is held in the annular channel.

7. The two liquid dispenser according to claim 1, wherein, the pouch has a flexible bag body and a fixing member which is fixed on an opening of the flexible bag body, and the flexible bag body is made of either two sheers that are overlapped with each other and fixed to one another at a periphery thereof, or one sheet folded and fixed to itself at a periphery thereof.

* * * * *